US012128468B2

(12) United States Patent
Dingle

(10) Patent No.: US 12,128,468 B2
(45) Date of Patent: Oct. 29, 2024

(54) APPARATUS AND METHOD FOR BENDING CONTOURED METAL SHEETING ABOUT A FOLD LINE

(71) Applicant: FORMFLOW PTY LTD, Victoria (AU)

(72) Inventor: Matthew Edward Dingle, Drysdale (AU)

(73) Assignee: FORMFLOW PTY LTD, Victoria (AU)

( * ) Notice: Subject to any disclaimer, the term of this patent is extended or adjusted under 35 U.S.C. 154(b) by 444 days.

(21) Appl. No.: 17/602,399

(22) PCT Filed: Apr. 7, 2020

(86) PCT No.: PCT/AU2020/050348
§ 371 (c)(1),
(2) Date: Oct. 8, 2021

(87) PCT Pub. No.: WO2020/206493
PCT Pub. Date: Oct. 15, 2020

(65) Prior Publication Data

US 2022/0203425 A1 Jun. 30, 2022

(30) Foreign Application Priority Data

Apr. 11, 2019 (AU) ..... 2019901258

(51) Int. Cl.
*B21D 13/02* (2006.01)
*B21D 11/20* (2006.01)
(Continued)

(52) U.S. Cl.
CPC ..... *B21D 11/206* (2013.01); *B21D 13/02* (2013.01); *E04C 2/08* (2013.01); *E04C 2/322* (2013.01)

(58) Field of Classification Search
CPC ..... B21D 11/206; B21D 11/20; B21D 13/02; B21D 13/08
See application file for complete search history.

(56) References Cited

U.S. PATENT DOCUMENTS 4,250,728 A 2/1981 King

FOREIGN PATENT DOCUMENTS

JP 2001225132 A 8/2001
WO WO-2018058183 A1 * 4/2018 ..... B21D 5/01

OTHER PUBLICATIONS

International Search Report for International Application No. PCT/AU2020/050348; International Filing date Apr. 7, 2020; Report Mail Date Jun. 29, 2020; 4 pages.
(Continued)

*Primary Examiner* — Debra M Sullivan
(74) *Attorney, Agent, or Firm* — CANTOR COLBURN LLP

(57) ABSTRACT

A method of bending a contoured metal sheet, the contoured metal sheet having a longitudinal axis extending along the length of the contoured metal sheet comprising:

securing a first sheet section of the contoured metal sheet in a securing section between a securing surface of a securing member and an engagement surface of an engagement member;

positioning at least part of a second sheet section of the contoured metal sheet in a forming section between a forming member having a pressing surface and a seating member having a seating surface;

moving the forming section and the securing section relative to one another to: bend the first sheet section the selected angle relative to the second sheet section over a first bending edge; and feed the second sheet section from between the pressing surface and the
(Continued)

seating surface, over a second bending edge, to between a forming surface and a backing surface; and positioning a following section substantially adjacent to the second bending edge to cooperate with the forming surface to engage and compress a portion of the second sheet section of the contoured metal sheet therebetween when the relative movement between the securing section and the forming section moves the backing surface to a position remote from the forming surface of the forming member.

20 Claims, 7 Drawing Sheets

(51) Int. Cl.
*E04C 2/08* (2006.01)
*E04C 2/32* (2006.01)

(56) References Cited

OTHER PUBLICATIONS

Written Opinion for International Application No. PCT/AU2020/050348; International Filing date Apr. 7, 2020; Report Mail Date Jun. 29, 2020; 3 pages.

* cited by examiner

APPARATUS AND METHOD FOR BENDING CONTOURED METAL SHEETING ABOUT A FOLD LINE

CROSS REFERENCE TO RELATED APPLICATIONS

This application is a National Stage application of PCT/AU2020/050348, filed Apr. 7, 2020, which claims priority to AU Application No. 2019901258, filed Apr. 11, 2019, both of which are incorporated by reference in their entirety herein.

TECHNICAL FIELD

The present invention generally relates to a method, an apparatus and tool for bending contoured metal sheeting over and about a bending edge. The invention is particularly applicable to producing sharp angle bends in contoured metal sheeting, such as corrugated metal sheet, that is suitable for corners and other angled sheet junction locations and it will be convenient to hereinafter disclose the invention in relation to that exemplary application. However, it is to be appreciated that the invention is not limited to that application and could be used to form various angled bends in contoured sheet material.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Many common structures such as houses, sheds, factories or retaining structures are clad with metal sheets that incorporate a contoured profile to provide aesthetic appeal, stiffness and strength to the structure. One particular example is corrugated steel sheeting used for the walls and roof on housing. A gap is typically left between the ends of the sheet at sharp corners in a structure where two sheets meet, for example at a corner formed between two walls or at the peak of a roof, which is covered later by a separate piece of planar (non-contoured) sheet metal which overlaps the end of the adjoining sheets and covers the gap.

A cover or capping piece is necessary because the contoured profile running along the length of the sheets make the sheets difficult bend and fold other than along a fold line that runs parallel to that the longitudinal axis of the contoured profile. It is therefore difficult to bend the sheets to form abrupt angles about a fold line that runs at any non-zero angle (for example 90°) to the longitudinal axis of the contoured profile between the sheets without kinking or damaging the sheet. The cover or capping piece is typically formed from a flat sheet material and sits on top of the profiled sheets thereby leaving a gap between the profile sheet and the capping piece. In many cases this needs to be sealed to prevent wind/air, dirt or animals from migrating under the capping and into the structure.

One contoured metal sheet bending process developed by the Applicant is taught in International Patent Publication No. WO2018/058183, the contents of which should be considered to be incorporated into this specification by this reference. The general process comprises engaging a first sheet section of the contoured metal sheet with a forming member which comprises a forming surface having a contour shaped with a substantially symmetrical mirror profile to the contoured profile of the first sheet section, so to bend the first sheet section of the metal sheet about a fold line relative to a second sheet section of the metal sheet and also transforms the contoured profile of the first sheet section into a new contoured profile comprising a symmetrical mirror of the contoured profile of the second sheet section about the fold line. The depth of the bend that can be produced by this apparatus and method is limited to the size of the tooling. Bends having a large depth, for example near the longitudinal center of that metal sheet require a long tool to transform the contoured profile of the first sheet section into a new contoured profile comprising a symmetrical mirror of the contoured profile of the second sheet section about the fold line. Tooling costs can be expensive if long bends are required.

It would therefore be desirable to provide an improved method and apparatus of producing sharp angled bends in contoured metal sheeting, for example a corrugated metal sheet.

SUMMARY OF THE INVENTION

A first aspect of the present invention provides a method of bending a contoured metal sheet, the contoured metal sheet having a longitudinal axis extending along the length of the contoured metal sheet, the contoured metal sheet having a contoured profile that extends perpendicular to the longitudinal axis of the contoured metal sheet, the method comprising:

(A) securing a first sheet section of the contoured metal sheet in a securing section between a securing surface of a securing member and an engagement surface of an engagement member, the securing section also including a backing surface positioned at a selected angle relative to the securing surface about a first bending edge formed therebetween;

(B) positioning at least part of a second sheet section of the contoured metal sheet in a forming section between a forming member having a pressing surface and a seating member having a seating surface, the seating member configured to cooperate with the forming member to engage the second sheet section between the pressing surface and the seating surface, and also allow the second section of contoured metal sheet to slide therebetween;

(C) moving the forming section and the securing section relative to one another to:

bend the first sheet section the selected angle relative to the second sheet section over the first bending edge; and feed the second sheet section from between the pressing surface and the seating surface, over a second bending edge, to between a forming surface and a backing surface, the forming surface being orientated the selected angle to the pressing surface about the second bending edge formed therebetween, the forming surface being shaped with a contour comprising a substantially symmetrical mirror profile to the contoured profile of the contoured metal sheet; and the backing surface having a complementary and cooperating profiled surface to the forming surface which is configured to cooperate with the forming surface to engage the second sheet section therebetween, thereby transforming the contoured profile of the second sheet section into a symmetrical mirror of that contoured profile; and (D) positioning a following section substantially adjacent to the second bending edge to cooperate with the forming surface to engage and compress a portion of the second sheet section of the contoured metal sheet therebetween when the relative movement between the securing section and the forming section moves the backing surface to a position remote from the forming surface of the forming member.

The method of the present invention allows the securing section to be positioned at a desired point along the length of a contoured metal sheet and position a bend, typically a sharp bend, at that point. The forming section can then be used to transform the contoured profile of the metal sheet from that bend or fold line into the symmetrical mirror image of that profile for any desired length. The position or length of the bend is not limited by the size of the tooling, in particular tool face. The present invention enables relatively small tools and tool faces to be used, with the position of the bend on a length of a contoured metal sheet to be limited only by relative travel distance allowed in the apparatus between the forming section and the securing section and related travel by the following section. This allows the bend to be positioned at any desired point along the length of the contoured metal sheet using a small, movable tooling and for the contours to run continuously on both sheet sections of the bent sheet and merge about the fold line making a neat join at the intersection of two sheets. The resulting structure provides a corner or other angled bend in a contoured metal sheet at any desired point along the length of that sheet.

It is to be understood the contoured metal sheet encompasses any metal sheet having a contoured profile that extends perpendicular to the longitudinal axis of the sheet. Any number of contoured profiles could extend along the longitudinal axis of the sheet, including regular and irregular profiles and shapes, repeating and non-repeating profile shapes. In preferred embodiments, the contoured metal sheet encompasses any metal sheet having a contoured profile having a repeating cross-sectional shape that extends perpendicular to the longitudinal axis of the sheet. A large variety of repeating cross-sectional shapes are possible, such as curved, triangular, or the like. In a number of embodiments, the repeating cross-sectional shape comprises repeating peaks and troughs. The width of the peaks and troughs along a lateral centreline (spanning the cross-section) can be equal in the repeating pattern, or in other embodiments the width of the peaks and troughs along a lateral centreline can be different, resulting in the width of the peak being greater than or less than the width of the trough. In some embodiments, the repeating peaks and troughs form are curved, preferably forming a curved wave form. However, it should be appreciated that the peaks and troughs can comprise any number of different shapes. In exemplary embodiments, the metal sheet comprises a corrugated metal sheet.

It should also be appreciated that metal sheet encompasses a wide variety of metal, metal alloys, and metal composites, including composite sheets fabricated from various layers of metals and non-metals, such as metal-polymer and/or metal-polymer-metal composites.

The following section is used to maintain engagement and compression on the second sheet section through the second bending edge and the forming surface once the backing surface moves to a position remote from interacting/cooperating with the forming surface. In embodiments, the backing surface becomes remote from the forming surface at a position where said surfaces are unable to cooperate to engage and compress the second sheet section therebetween. In a number of embodiments, the backing surface forms part of the securing member. In such embodiments, the relative movement between the securing section and forming section, typically embodied in relative movement of the forming member and securing member apart, moves (linearly translates) the backing surface away from the forming member to a position where the surfaces are not in opposition and thus are unable cooperate to engage and compress the second sheet section. The following section is designed to take the place of the backing surface and cooperate with the forming surface to engage and compress the second sheet section at a point adjacent to the second bending edge.

The following section preferably includes a second backing surface having a complementary and cooperating profiled surface to the forming member. This ensures that the material follows the geometry of the tooling precisely as it flows over the second bending radius and are compressed by engagement surfaces that match the outer surface profile of the contoured metal sheet as the bend is produced. Again, this allows the following section to cooperate with the forming surface to engage and compress the second sheet section at a point adjacent to the second bending edge. In operation, the second backing surface of the following section is initially positioned adjacent to and aligned with the backing surface. Similarly, the following section is preferably initially positioned adjacent with and aligned with the securing member. Once the backing surface becomes remote from the forming surface, the second backing surface of the following section is utilised to cooperate with the forming surface to engage and compress the second sheet section at a point adjacent to the second bending edge.

Relative movement between the securing section and forming section preferably also positions the second sheet section at the selected angle relative to the third sheet section. Engagement of the second sheet section over the second bending edge and with the forming member therefore can act to both bend the metal sheet through the selected angle and reform/transform the contoured profile of the second sheet section into the new contoured profile. It is preferable that the bend radius of the second bending edge is small enough to provide sharp change in angle at the fold line. In embodiments, in typical thin sheet (for example 0.5 to 1 mm thick), the bend radius is less than 5 mm, preferably less than 3 mm, more preferably about 2 mm. However, the limits of the bend radius will depend on both the material properties and on the thickness of the sheet. Moreover, the sharp angle bend is preferably configured as a transverse bend.

The backing surface can have any required size to fulfil its function. In embodiments, the second bending edge has a second bend radius and the second backing surface overlaps the second bend radius by at least the size of the bend radius, and preferably at least twice the size of the bend radius. However, it should be appreciated that other sizes could be used to cooperate with the forming surface to engage and compress the second sheet section at a point adjacent to the second bending edge.

The first sheet section of the contoured metal sheet can be secured in the securing section using a variety of different arrangements. In exemplary embodiments, the securing section releasably secures the first sheet section therein. For example, in some embodiments, the first sheet section of the contoured metal sheet is clamped in the securing section between the securing surface of a securing member and the engagement surface of an engagement member.

The securing surface is preferably formed with cooperating profiled surface to the contours of the first sheet section, and the engagement surface has a complementary and cooperating profiled surface to the securing surface which is configured to cooperate with the securing surface to engage and clamp the first sheet section therebetween. In some embodiments, the first sheet section is intended to be formed with the same contours as the overall contoured metal sheet. In other embodiments, the first sheet section is intended to be formed with the symmetrical mirror image of the profile of the overall contoured metal sheet. In such an embodiment, the securing surface and engagement surface can have matching profiles to the forming surface and backing surface, and initially form an extension of these surfaces prior to the securing section and forming section being moved apart relative to each other.

Similarly, the pressing surface preferably has a cooperating profiled surface to the contours of the contoured metal sheet and the seating surface has a complementary and cooperating profiled surface to the pressing surface of the forming member. The complementary and cooperating profiled surface assist in engagement between the surfaces and the section of contoured metal sheet extending between these opposing surfaces.

In a number of embodiments, the backing surface forms part of the securing member. In such embodiments, the relative movement between the securing section and forming section, typically embodied in relative movement of the forming member and securing member apart, moves (linearly translates) the backing surface away from the forming member to a position where the surfaces are not in opposition and thus are unable cooperate to engage and compress the second sheet section.

The backing surface is positioned at the selected angle relative to the securing surface about a first bending edge formed therebetween. This enables the first sheet section to be bent at the selected angle relative to the second sheet section during relative movement between the securing section and the forming section. The selected angle between the backing surface and the securing surface can comprise any suitable angle. In embodiments, the selected angle between the backing surface and securing surface is between 5 and 175°, preferably between 10 and 150°, more preferably between 50 and 140°, and yet more preferably between 60 and 120°. In some embodiments, the selected angle is between 70 and 140°. In particular embodiments the selected angle is between 50 and 140°, preferably between 60 and 120°. In embodiments, the angle is 120°. In other embodiments, the angle is 90°. It should also be appreciated that the backing surface is positioned at the selected angle relative to the pressing surface. Here, two spaced apart fold lines are formed along the length of the contoured metal sheet for at least part of the sheet bending process.

The second sheet section can also be bent about the fold line at a variety of angles relative to the third sheet section. As noted above, the selected angle between the forming surface and pressing surface can be between 5 and 175°, preferably between 10 and 150°, more preferably between 50 and 140°, and yet more preferably between 60 and 120°. The angle between the forming surface and pressing surface is preferably the same as between the backing surface and the securing surface.

The relative movement between the securing section and forming section can have a number of different forms. In most embodiments, this relative movement comprises at least one of: the securing section being held stationary, and the forming section being moved away from the securing section; or the forming section being held stationary, and the securing section being moved away from the forming section. In most cases, that relative movement will include the forming surface and backing surface sliding apart relative to one another. Such movement can be facilitated by the forming surface and the backing surface being spaced apart, preferably parallel space apart, such that in use, the second sheet section can be engaged and deformed therebetween, and allow relative lateral sliding movement, between at least the forming surface and the second sheet section. Such sliding movement is usually a linear translation movement where the forming surface and the backing surface are parallel spaced apart, and laterally slide apart relative to one another along the longitudinal length of the second sheet section that extends therebetween. Here the forming member is preferably moved over the second sheet section.

Relative movement between the securing section and forming section bends the second section relative to the first section over the first bending edge to preferably form a sharp angle bend between the first sheet section and the second sheet section about a fold line. The sharp angle bend at the fold line can have a bend radius of less than 5 mm, preferably less than 3 mm. In embodiments, the first bending edge also provides a bend radius (second bend radius) about which the metal sheet is bent. That first bend radius is typically less than 5 mm, preferably less than 3 mm, more preferably about 2 mm.

Engagement and traverse of the second sheet section across the second bending edge to the forming surface transforms the contoured profile of the second sheet section into a new contoured profile comprising a symmetrical mirror of the contoured profile of the third sheet section about the fold line. At this bend radius, the contours preferably run continuously on both the pressing surface and the forming surface and merge about the further bend radius making a neat join at the intersection between the pressing surface and the forming surface. It should be appreciated that the second bending edge also includes a bend radius. That second bend radius is typically less than 5 mm, preferably less than 3 mm, more preferably about 2 mm.

The fold line between the first sheet section and second sheet section preferably forms a transverse bend, i.e. is orientated 90 degrees to the longitudinal axis of the metal sheet. It should be noted that fold line follows the junction between the first sheet section and second sheet section and therefore follows the contours between those sheets, and therefore can be a curved line where it follows those contours at this junction.

In some embodiments, the contoured metal sheet is also bent about at least one further fold line, known hereafter as a second fold line. The second fold line between the second sheet section and third sheet section preferably forms a transverse bend, i.e. is orientated 90 degrees to the longitudinal axis of the metal sheet. It should be noted that fold line follows the junction between the second sheet section and third sheet section and therefore follows the contours between those sheets, and therefore can be a curved line where it follows those contours at this junction. Where two fold lines are present, the first and second fold lines are preferably orientated 90 degrees to the longitudinal axis of the metal sheet.

It should be appreciated that a number of different metal sheets can be used in the method of the present invention. The exact dimensions, including thickness depends on the size of desired product, size of the machinery and the material properties of the sheet. For example, different metals have different plastic deformation properties, which affect the bending and reforming properties of the metal sheet. Nevertheless, in some embodiments the metal sheet may have a thickness of 0.1 to 3 mm, preferably 0.2 to 2 mm. However, the limits of the bend radius will depend on both the material properties and on the thickness of the sheet.

A second aspect of the present invention provides a bending arrangement for bending a contoured metal sheet, the contoured metal sheet having a longitudinal axis extending along the length of the contoured metal sheet, the contoured metal sheet having a contoured profile that extends perpendicular to the longitudinal axis of the contoured metal sheet, the bending arrangement comprising:

(A) a securing section including a securing member having a securing surface and an engagement member having an engagement surface which is configured to cooperate with the securing surface to engage and secure a first sheet section of the contoured metal sheet therebetween, the securing section also including a backing surface positioned at a selected angle to the securing surface about a first bending edge formed therebetween;

(B) a forming section including:

a forming member having a pressing surface and a forming surface, the forming surface being orientated at a selected angle to the pressing surface about a second bending edge formed therebetween, the forming surface being shaped with a contour comprising a substantially symmetrical mirror profile to the contoured profile of the contoured metal sheet, the backing surface having a complementary and cooperating profiled surface to the forming surface of the forming member, the forming surface being configured to cooperate with the backing surface to engage and compress a sheet section of the contoured metal sheet therebetween; and the seating member including an engagement surface, the seating member configured to cooperate with the forming member to engage at least a portion of a second sheet section of the metal sheet between the pressing surface and the seating surface, and also allow the second sheet section of contoured metal sheet to slide therebetween, (C) a following section configured to be positioned adjacent to the second bending edge to cooperate with the forming surface to engage and compress a sheet section of the contoured metal sheet therebetween when the backing surface of the securing member becomes remote from the forming surface, wherein the forming section and securing section are configured to move relative to one another to feed the second sheet section from between the pressing surface and seating surface over the second bending edge and between the forming surface and backing surface and thereby:

position the first sheet section at the selected angle relative to the second sheet section of the contoured metal sheet; and transform the contoured profile of the second sheet section into a new contoured profile comprising a symmetrical mirror of that contoured profile.

It should be understood that the arrangement of this second aspect of the present invention can be used in forming the contoured metal sheet using the method according to the first aspect of the present invention. The above described features of the first aspects of the present invention should therefore be understood to be equally applicable to this second aspect of the present invention.

As noted in relation to the first aspect of the present invention, the backing surface becomes remote from the forming surface at a position where said surfaces are unable to cooperate to engage and compress the second sheet section therebetween. The forming surface and backing surface are typically parallel spaced apart with a section of the contoured metal sheet extending therebetween. Moreover, the forming surface and the backing surface are preferably configured to slide apart relative to one another. During relative movement of the securing section and forming section, these two surfaces slide laterally apart along the longitudinal axis of the section of metal sheet extending therebetween. The backing surface becomes remote from the forming surface once the surfaces have translated to a point where they are not opposing each other, and thus unable to cooperate to engage and compress the second sheet section therebetween. In some embodiments, the backing surface comprises part of the securing member.

Again, the following section includes a second backing surface having a complementary and cooperating profiled surface to the forming member. That second backing surface is configured to replace the function of the backing surface once the backing surface becomes remote from the forming surface.

The backing surface can have any required size to fulfil its function. In embodiments, the second bending edge has a second bend radius and the second backing surface overlaps the second bend radius by at least the size of the bend radius, and preferably at least twice the size of the bend radius.

The contoured profile of the second sheet section is transformed into a new contoured profile comprising a symmetrical mirror of the original contoured profile of the second sheet section by passing over the second bending edge and to a position between the forming surface and the backing surface or second backing surface. The transformed contoured profile of the second sheet section is a symmetrical mirror of the contoured profile of a third sheet section now engaged between the pressing surface and seating surface, and also the symmetrical mirror of the contoured profile of the first sheet section and also a symmetrical mirror of the contoured profile of overall/original contoured profile of the contoured metal sheet). The second bending edge preferably forms a second bend radius R1 about which the contoured metal sheet is bent and R1 comprises a bend radius of less than 5 mm, preferably less than 3 mm.

Relative movement between the forming section and securing section can also act to position the second sheet section at the selected angle relative to a third sheet section now engaged between the pressing surface and seating surface. The selected angle between the forming surface and pressing surface can comprise any suitable angle. In embodiments, the selected angle between the forming surface and pressing surface is between 5 and 175°, preferably between 10 and 150°, more preferably between 50 and 140°, and yet more preferably between 60 and 120°. In some embodiments, the selected angle is between 70 and 140°. In particular embodiments, the selected angle is between 50 and 140°, preferably between 60 and 120°. In embodiments, the angle is 120°. In other embodiments, the selected angle is 90°.

It should be appreciated that the folding plane (or plane of symmetry across the fold line) between the forming surface and pressing surface (and the resulting first sheet section and second sheet section) (which runs through the fold line) is the half-angle between those surfaces. This creates a symmetrical mirror image of the contoured profile of the metal sheet across the fold line. For example, when the forming surface and pressing surface are orientated 90° apart (thus forming a 90° bend between the second sheet section and first sheet section), the folding plane sits 45° between the faces of those surfaces. When the forming surface and pressing surface are orientated 120° apart (thus forming a 120° bend between the second sheet section and third sheet section—and a 30 degree angle with each sheet section to the horizontal), the folding plane sits 60° between the faces of those surfaces.

As described previously for the first aspect, the first sheet section of the contoured metal sheet can be secured in the securing section using a variety of different arrangements. In exemplary embodiments, the securing section releasably secures the first sheet section therein. For example, in some embodiments, the first sheet section of the contoured metal sheet is clamped in the securing section between the securing surface of a securing member and the engagement surface of an engagement member.

The backing surface is preferably positioned at angle to the securing surface about a first bending edge formed therebetween which is complementary to the selected angle. The first bending edge preferably forms a first bend radius R2 about which the contoured metal sheet is bent, and R2 comprises a bend radius of less than 5 mm, preferably less than 3 mm.

As noted in relation to the first aspect, the backing surface and the securing surface are preferably located at a desired angle relative to one another corresponding to the desired angle to be formed between the second sheet section and third sheet section about the first fold line. The desired angle between the backing surface and the securing surface can comprise any suitable angle. In embodiments, the desired angle between the backing surface and the securing surface is between 5 and 175°, preferably between 10 and 150°, more preferably between 50 and 140°, and yet more preferably between 60 and 120°. In some embodiments, the desired angle is between 70 and 140°. In particular embodiments the desired angle is between 50 and 140°, preferably between 60 and 120°. In embodiments, the angle is 120°. In other embodiments, the selected angle is 90°. The forming section and securing section are preferably configured to move relative to one another to also position the second sheet section at the selected angle line relative to the first sheet section about a second fold line.

The securing surface preferably has a cooperating profiled surface to the contours of the contoured metal sheet. The engagement surface preferably has a complementary and cooperating profiled surface to the securing surface which is configured to cooperate with the securing surface to engage and clamp the first sheet section therebetween. The first sheet section can therefore be pressed between the securing surface and engagement surface without deforming the contoured profile of that first sheet section.

The backing surface is provided having a complementary and cooperating profiled surface to the forming surface which is configured to cooperate with the forming surface to engage and compress the first sheet section therebetween. The backing surface therefore cooperates with the forming surface to both bend the metal sheet about the fold line and reform/transform the contoured profile of the second sheet section. The backing surface is preferably positioned at the selected angle relative to the securing surface about the second bending edge. In embodiments, the forming surface and backing surface are spaced apart, in use, so that the second sheet section can be engaged and deformed therebetween, and allow relative lateral sliding movement, between at least the forming surface and the second sheet section. Overall, this enables the second sheet section to be: engaged and deformed therebetween; and allows relative lateral movement, preferably sliding movement, between the second sheet section and at least the forming member. In this respect, the forming member is preferably configured to allow movement between the forming member and the second sheet section. Preferably, the forming surface is configured to be moved over the second sheet section. However, it should be appreciated that the forming surface could alternatively be configured to allow the second sheet section to be moved relative to the forming surface to achieve a similar outcome.

The forming surface and pressing surface meet at a second bending edge about which the contoured profile of the forming surface and the contoured profile pressing surface form symmetrical mirror profiles. Whilst a variety of angles could be used, the pressing surface is preferably orientated at the selected angle to the forming surface and configured with a complementary and cooperating profiled surface to the metal sheet. The pressing surface is preferably positioned on the forming member to contact a portion of the second section of the metal sheet prior to the forming process. That bending edge also provides a bending radius about which the metal sheet is bent. That bend radius is typically less than 5 mm, preferably less than 3 mm, more preferably about 2 mm.

The pressing surface of the forming member can be configured to cooperate with a complementary and cooperating profiled surface seating surface on the seating member. In embodiments, the pressing surface has a cooperating profiled surface to the contours of the contoured metal sheet and the seating surface has a complementary and cooperating profiled surface to the pressing surface of the forming member. The pressing surface and seating surface are preferably spaced apart to allow a section of metal sheet seated therebetween to move, preferably slide therebetween.

The arrangement could be configured to be used with any suitable contoured metal sheet as outlined above. In embodiments, the contoured profile of the metal sheet may comprise a repeating cross-sectional shape, for example one that comprises repeating peaks and troughs. In some embodiments, the repeating peaks and troughs form a curved wave form. However, it should be appreciated that any number of other cross-sectional profiles are possible including triangular or the like.

The arrangement of this second aspect of the present invention preferably comprises a tooling arrangement used to bend a contoured metal sheet with a sharp angled bend between the first sheet section and second sheet section thereof. The forming member, backing member, securing member and following member preferably comprise separate tool elements of this tool arrangement.

The contoured metal sheet element can be formed from any suitable contoured metal sheet as outlined above. In embodiments, the contoured profile of the metal sheet may comprise a repeating cross-sectional shape, for example a repeating cross-sectional shape that comprises repeating peaks and troughs. In some embodiments, the repeating peaks and troughs form a curved wave form. However, it should be appreciated that any number of other cross-sectional profiles are possible including triangular or the like. Similarly, the metal sheet can comprise any suitable metal or metal composite. Again, it should also be appreciated that metal sheet encompasses a wide variety of metal, metal alloys, and metal composites, including composite sheets fabricated from various layers of metals and non-metals, such as metal-polymer and/or metal-polymer-metal composites. In some embodiments, the metal sheet comprises at least one of an iron, steel, aluminium or copper metal sheet. The sheet may be coated, for example with paint or other similar film coating or another metal coating, such as a zinc coating (galvanized coating). In some embodiments, the metal sheet has a thickness of 0.1 to 3 mm, preferably from 0.2 to 2 mm.

A third aspect of the present invention provides a contoured metal sheet element formed from a method according to the first aspect of the present invention.

BRIEF DESCRIPTION OF THE DRAWINGS

The present invention will now be described with reference to the figures of the accompanying drawings, which illustrate particular preferred embodiments of the present invention, wherein.

DETAILED DESCRIPTION

The present invention relates to a method and apparatus for bending a contoured metal sheet (for example corrugated metal sheet 100 in FIG. 1).

Contoured Metal Sheets

The formation of contoured metal sheets is well known in the art, typically using a roll forming process which utilises a series of spaced apart convex and/or concave shaping rollers to achieve the desired cross-sectional profile in the sheet transverse to the rolling direction. Each roller is forced downwardly under pressure to deform the sheet as it passes through the rollers to form the desired repeating contoured profile in the sheet. In other forms, the rolls can be stationary and arranged in stations spaced apart longitudinally so the sheet is progressively deformed into the final shape through a series of sequential forming steps. The resulting metal sheet has a contoured profile that extends perpendicular to the longitudinal axis (rolling direction/axis) of the metal sheet. Where the rollers have a regular shape profile and/or spacing over a portion of the sheet that contoured profile can have a repeating cross-sectional shape that extends perpendicular to the longitudinal axis of the metal sheet.

Figure 1A:
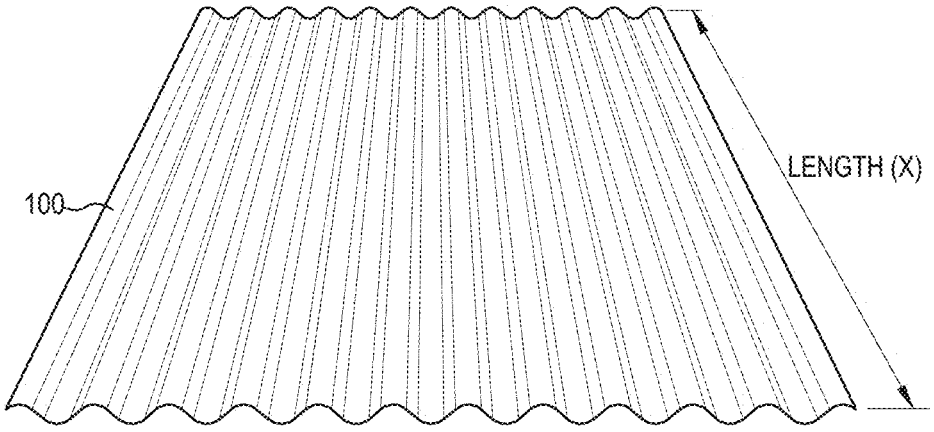
FIG. 1 is shows an example of one type of contoured metal sheet that can be formed using the method and tool arrangement of embodiments of the present invention, showing (A) a front perspective view of the contoured metal sheet; (B) a cross-sectional schematic providing general dimensional details; and (C) symmetrical overlap of peaks and troughs of two contoured metal sheets.
Figure 1B:
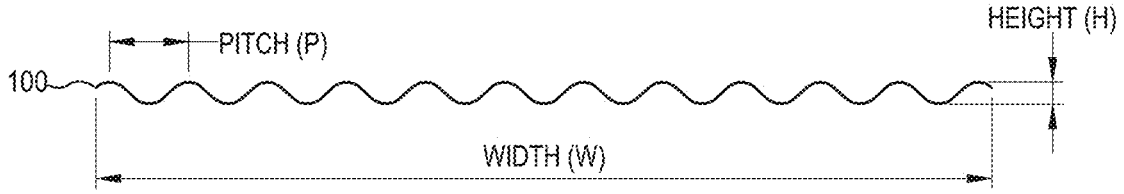
Figure 1C:
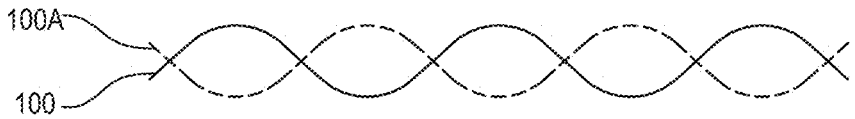

A large variety of repeating cross-sectional shapes are possible, such as curved, triangular, or the like. Whilst not wishing to be limiting to the present invention, FIG. 1 shows one form of contoured metal sheet that can be utilized in the present invention. FIG. 1 shows a curved corrugated metal sheet 100 having a curved repeating cross-sectional shape comprises repeating peaks and troughs. The longitudinal axis direction is shown in FIG. 1(A) by arrow X. The pitch (P), width (W) and height (H) dimensions that can be used to characterise this type of corrugated metal sheet 100 are illustrated in FIG. 1(B). It is to be understood that a corrugated metal sheet 100 having a variety of suitable pitch (P), width (W) and height (H) dimensions can be used in the present invention. Similarly, the metal sheet 100 can be formed from any suitable metal such as iron, steel, aluminium or copper metal sheet and may be coated (painted or zinc coated) in some forms. It should also be appreciated that the metal sheet encompasses a wide variety of metal, metal alloys, and metal composites, including composite sheets fabricated from various layers of metals and non-metals. Whilst it should be appreciated that different metals have different plastic deformation properties, which affect the bending and reforming properties of the metal sheet, the metal sheet used in the present invention typically has a thickness of 0.1 to 3 mm, preferably from 0.2 to 2 mm.

Bent Contoured Metal Sheets

The present invention enables a sharp bend to be made in a metal sheet with a contoured profile running at the selected angle to the bend about the fold line. One contoured metal sheet bending process developed by the Applicant is taught in International Patent Publication No. WO2018/058183. The process generally involves drawing a sheet of corrugated metal having a contoured profile over a forming radius specifically designed to produce a geometry that is the symmetrical inverse (out of phase reflection) of the original profile contoured profile. Here, a sharp angled bend can be formed in a contoured metal sheet when the contoured profile of sheet sections connected across a fold line have substantial symmetrical mirror image profile. This allows the contours to run continuously on both sheet sections of the bent sheet making a neat join at the intersection of the two sheet sections.

It is necessary to have tool surfaces that match the outer surface profile of the sheet as the bend is produced to ensure that the material follows the geometry of the tooling precisely as it flows over the bending radius. The process and tooling taught in WO2018/058183 require a very long tool to be used to position the bend at a position that is away from the edge portion of the metal sheet. The tool length matches the longitudinal length the bend is required to be positioned away from the edge portion. A long tool increases the size, weight and cost of tooling.

The present invention modifies the process and tooling taught in WO2018/058183 to use a follower tool (see 450 in FIGS. 3 to 5) that is designed to control compression and engagement of the portion of the metal sheet passing over the forming radius (bending edge) in this specific region and moves with the forming radius and associated tooling along the required length of the metal sheet, thereby alleviating the need to have a large, heavy and expensive tool. The resulting apparatus, tooling and process is more economical, facilitates the installation and removal of tooling and reduces the cost of hardening or coating the tooling.

Figure 2A:
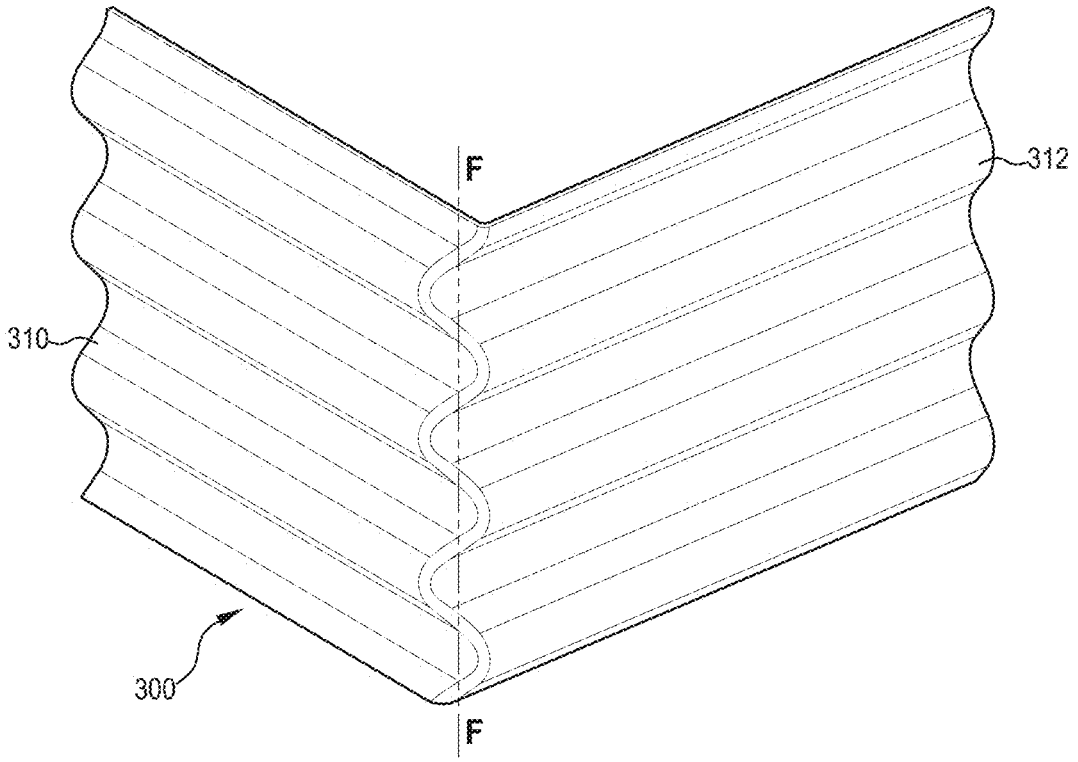
FIG. 2 illustrates a first embodiment of contoured metal sheet corner element according to the present invention, showing (A) a first perspective view; (B) a second perspective view; and (C) a side elevation view.
Figure 2B:
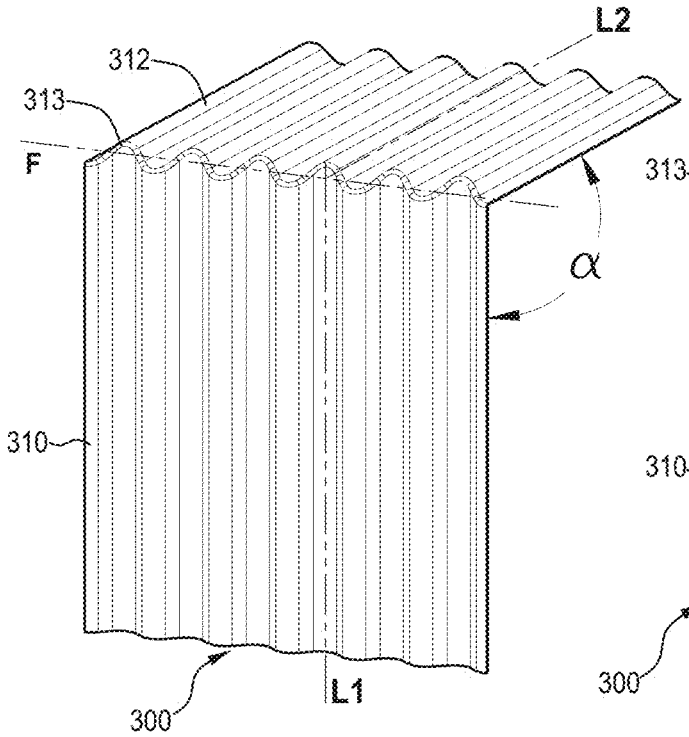

FIG. 2 shows a first embodiment of a contoured metal sheet element 300 according to the present invention. The illustrated contoured metal sheet element 300 has been formed from a corrugated metal sheet 100 such as shown in FIG. 1. The contoured metal sheet element 300 comprises a first sheet section 310 of contoured metal sheet and a second sheet section 312 of contoured metal sheet. Each of the first sheet section 310 and second sheet section 312 have a longitudinal axis L1, L2 (FIG. 2(B)) extending along the length of the respective sheet section 310, 312 and a curved contoured profile that extends perpendicular to the respective longitudinal axis L1, L2. The first sheet section 310 and the second sheet section 312 are connected about transverse fold line F which is angled 90 degrees to the respective longitudinal axes L1 and L2. Fold line F is in the middle of the sheet, away from the edge positions of sheet sections 310 and 312. It should be noted that fold line follows the junction between the first sheet section and second sheet section and therefore follows the contours between those sheets, and is therefore a curved line where it follows those contours at this junction. The first sheet section 310 extends at a 90 degree angle (angle α in FIGS. 2(A) and 2(B)) relative to the second sheet section from the fold line F to form a right angle corner bend. However, the uniqueness of this bend is that the repetitive contour of the first sheet section 310 has a symmetrical mirror contoured profile to the second sheet section 312 about the fold line F. As noted above, this allows the contours to run continuously on both sheet sections of the bent sheet and merge about the fold line F in a transitional contour thereby making a neat join at the intersection of the two sheet sections 310 and 312.

Figure 2C:
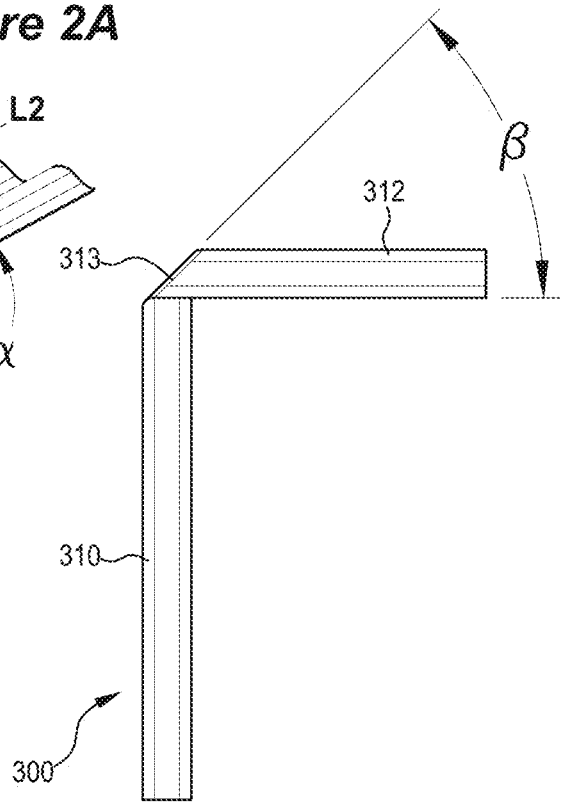

As shown in FIG. 2(C), the first sheet section 310 is orientated at a sharp angle bend relative to the second sheet section 312 about that fold line. That sharp angle bend at the fold line typically has a bend radius of less than 5 mm, preferably around 2 mm. That bend produces a flat, in this case 45 degree fold surface 313 between the first sheet section 310 and second sheet section 312. The angle of that fold surface 313 corresponds to the angle of the fold plane (see FIG. 5).

Nevertheless, it should be appreciated that the first sheet section 310 can be angled about the fold line F at a variety of angles relative to the second sheet section 312. For example, the first sheet section 310 may be angled at angle α=120 degrees about the fold line F relative to the second sheet section 312.

Tooling Arrangement

Figure 3:
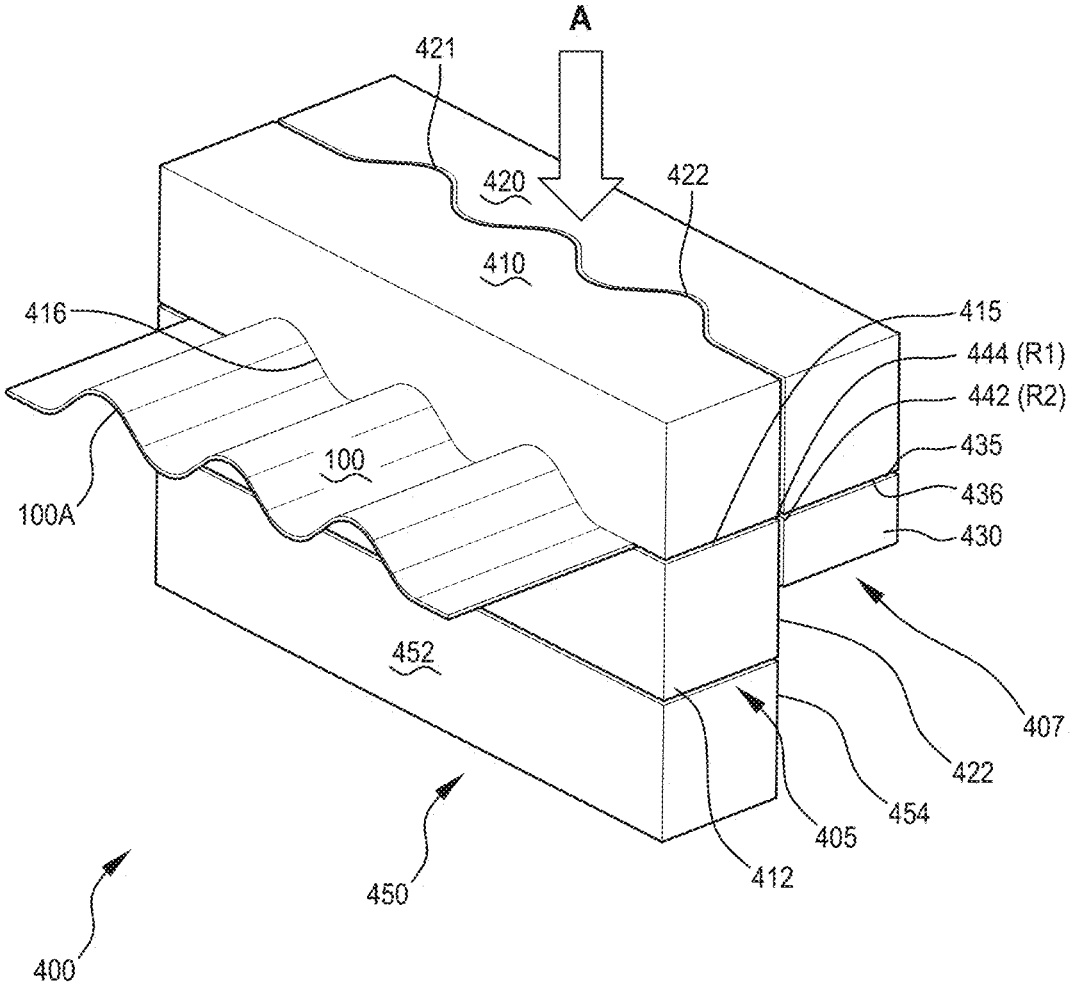
FIG. 3 illustrates a tooling arrangement according to an embodiment of the present invention for forming the contoured metal sheet corner element shown in FIG. 2.

A tooling arrangement 400 that can be used to form the contour metal sheet element 300 shown in FIG. 2 is illustrated in FIGS. 3 to 5. The illustrated tooling arrangement 400 forms a transverse bend in a metal sheet having a contoured profile such as the corrugated metal sheet 100 illustrated and described in relation to FIG. 1. That transverse bend can be placed at any length along the corrugated metal sheet 100, selected at the point the metal sheet 100 is placed in securing section 405.

As shown in FIG. 3, the tooling arrangement 400 comprises a five piece tool which includes five die sections, separated into three sections—a securing section 405, a forming section 407 and a following section 450.

The securing section 405 is formed from an upper engagement die 410 and a lower securing die 412. The lower securing die 412 includes a securing surface 415 having a complementary profile to the section of contoured metal sheet 100 that is seated thereon in use. Similarly, the upper engagement die 410 includes an engagement surface 416 having a complementary profile to the section of contour metal sheet 100 that is seated thereon in use. The engagement surface 416 also has a complementary and cooperating profiled surface to the securing surface 416. The upper engagement die 410 and a lower securing die 412 are configured to receive a section of the metal sheet 100 at a point where the bend or fold is required to be formed. A length of metal sheet 100A extends out from the securing section 405. The upper engagement die 410 and a lower securing die 412 cooperate to engage and clamp a section of the metal sheet 100 between the respective engagement surface 416 and securing surface 415. This enables a section of the metal sheet 100 to be tightly secured between the securing surface 415 and the cooperating engagement surface 416 without deforming the contoured profile of that section of the metal sheet 100. The securing section 405 can therefore be positioned at a desired point along the length of the metal sheet 100 to position a bend at that point.

The forming section 407 is formed of forming die 420 having a forming surface 421 orientated at a selected angle to the securing surface 415, in the illustrated embodiment that angle is 90 degrees about second forming edge 442. However, it should be appreciated that that angle could be any suitable angle between 5 and 175 degrees. The forming surface 421 has a contour which is shaped with a substantially symmetrical mirror profile to the contoured profile of the section of metal sheet secured in the securing section 405.

The forming section 407 also includes a backing surface 422 formed on one side of the engagement die 410 and securing die 412. The backing surface 422 has a complementary and cooperating profiled surface to the forming surface 421 which is configured to cooperate with the forming surface 421 to engage and compress an adjoining sheet section to the secured sheet section of the contoured metal sheet 100 therebetween. The backing surface 422 is positioned at the selected angle relative to the securing surface 415, in the illustrated embodiment 90 degrees about first forming edge 444. However, it should be appreciated that those surfaces could be positioned at any desired relative angle to one another between 5 and 175 degrees. The forming surface 421 and cooperating backing surface 422 are also spaced apart, in use, so that the forming die 420 is able to slide over a sheet section of contoured metal sheet 100 placed therebetween but still enable that sheet section to be engaged and deformed as described below. It should be appreciated that the contoured profile of the securing surface 415 and the contoured profile of the backing surface 422 will be symmetrical mirror profiles about the first forming edge 444 where those two surfaces meet.

The first forming edge 444 forms a first bend radius R1 about which the metal sheet 100 is bent to form the desired sharp angle bend in the metal sheet 100. At this first bend radius R1 the contours preferably run continuously on both the contoured profile of the securing surface 415 and the contoured profile of the backing surface 422 and merge about first bend radius R1.

In the illustrated embodiment, the forming section also includes seating die 430. Seating die 430 includes a seating surface 435 having a complementary profile to the section of contoured metal sheet 100 that is seated thereon in use. Forming die 420 also includes a pressing surface 436 having a complementary profile to the section of contour metal sheet 100 that is seated thereon in use. The pressing surface 436 also has a complementary and cooperating profiled surface to the seating surface 435. The pressing surface 436 and seating surface 435 seat a section of contoured metal sheet 100 therebetween. However, these surfaces are spaced apart to allow the contoured metal sheet 100 to slide therebetween when the forming die 420 is moved. Each surface provides a guide to movement of the metal sheet 100 therebetween. A length of metal sheet 1006 (not shown in FIG. 3, but shown in FIG. 4) extends out from between the pressing surface 436 and seating surface 435 corresponding to the length of the second section 106 that is to be passed over a second bending edge 442 (see below).

The pressing surface 436 and seating surface 435 are also configured to cooperate to engage and press on the section of metal 100 therebetween to assist forming a right angled bend when passing over second bending edge 442. It should be appreciated that the contoured profile of the forming surface 421 and the contoured profile of the pressing surface 436 will be symmetrical mirror profiles about the second bending edge 442 where those two surfaces meet. The second bending edge 442 forms a second bend radius R2 about which the metal sheet 100 is bent. At this second bend radius R2 the contours preferably run continuously on both the contoured profile of the forming surface 421 and the contoured profile of the pressing surface 436 and merge about second bend radius R2.

It should also be noted that bend radius R1 and R2 are typically less than 5 mm, and typically around 2 mm.

The backing surface 422 and the forming die 420 are configured to cooperate to reform/transform the contoured profile of the sheet section of contoured metal sheet 100 engaged by the forming die 420 about second bending edge 442. The forming section 407 can then be used to transform the contoured profile of the metal sheet 100 from the bend or fold line defined at the first bending edge 444 into the symmetrical mirror image of that profile for any desired length.

The following section 450 is formed of following die 452 having a second backing surface 454 formed on one side. The second backing surface 454 has an identical profiled surface to the backing surface 422 (comprising a complementary and cooperating profiled surface to the forming surface 421) which is configured to cooperate with the forming surface 421 to engage and compress an adjoining sheet section to the secured sheet section of the contoured metal sheet 100 therebetween. The second backing surface is also aligned with the second backing surface 422 at a positioned at the selected angle relative to the securing surface 415, in the illustrated embodiment 90 degrees.

The following section is used to maintain engagement and compression on a sheet section of the metal sheet 100 that is passing over the second bending and to the forming surface once the forming die 420 moves to a position remote from the securing die 420, and the forming surface 421 and backing surface 422 are unable to cooperate to engage and compress a sheet section therebetween. As will be explained below, relative movement between the securing section 405 and forming section 407, typically embodied in relative movement of the forming die 420 and securing die 421 apart, moves (linearly translates) the backing surface 422 away from the forming surface 421 to a position where the surfaces are not in opposition and thus are unable cooperate to engage and compress the a section of the metal sheet 100 therebetween. The following section 450 is designed to take the place of the backing surface 422 and cooperate with the forming surface 421 to engage and compress the sheet section at a point adjacent to the second bending edge 442.

In embodiments, the second backing surface 454 overlaps the second bend radius R2 by at least the size of the second bend radius R2, and preferably at least twice the size of the second bend radius R2. However, it should be appreciated that other sizes could be used to cooperate with the forming surface 421 to engage and compress the second sheet section 106 at a point adjacent to the second bending edge 442.

Method of Using Tooling Arrangement

Figure 4A:
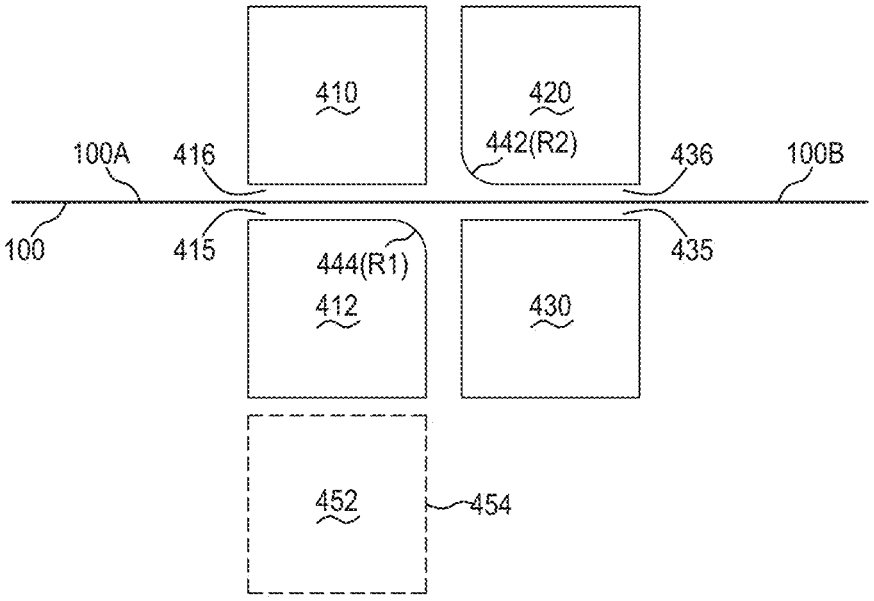
FIG. 4 provides process schematics for forming a contoured metal sheet corner element using the tooling arrangement illustrated in FIG. 3. It should be noted that FIG. 4 provides conceptual representations of the method and are not to scale.
Figure 4B:
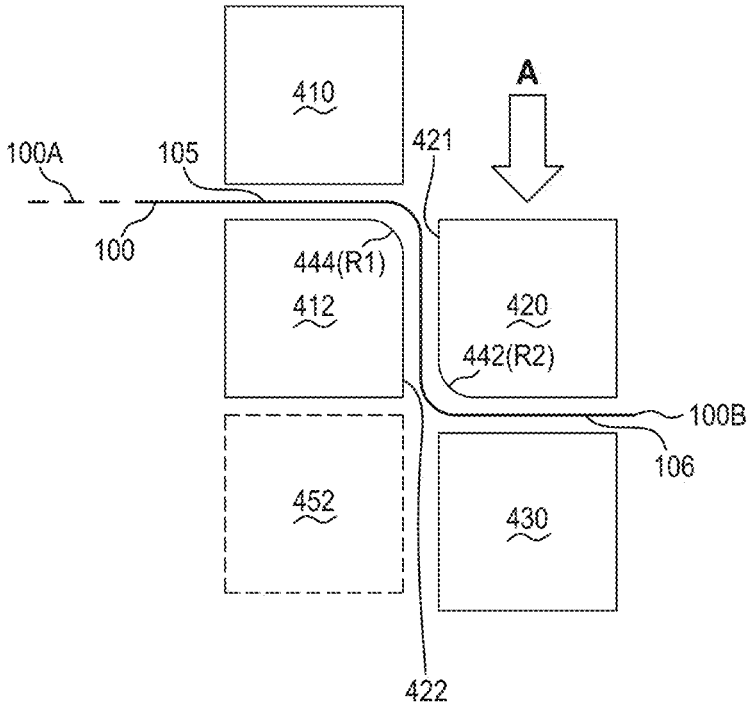
Figure 4C:
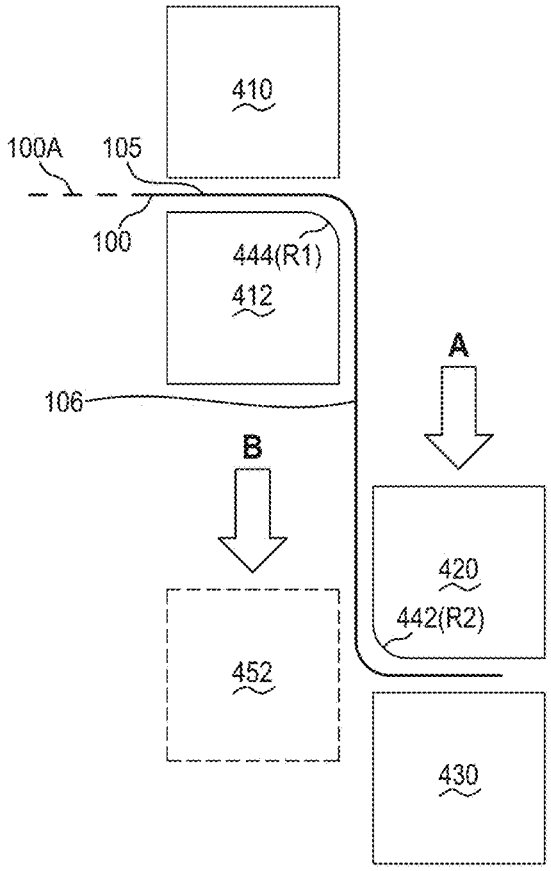
Figure 4D:
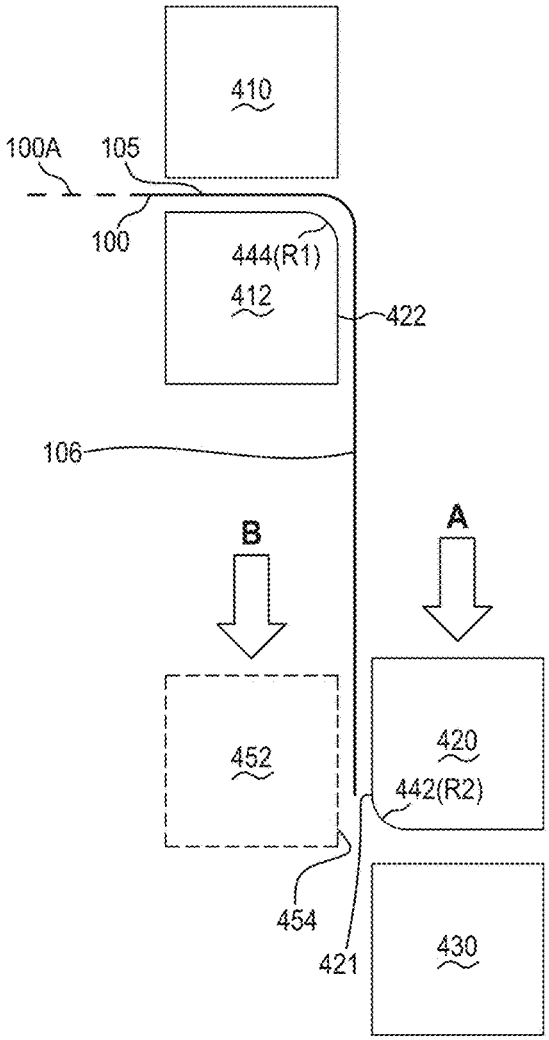
Figure 5A:
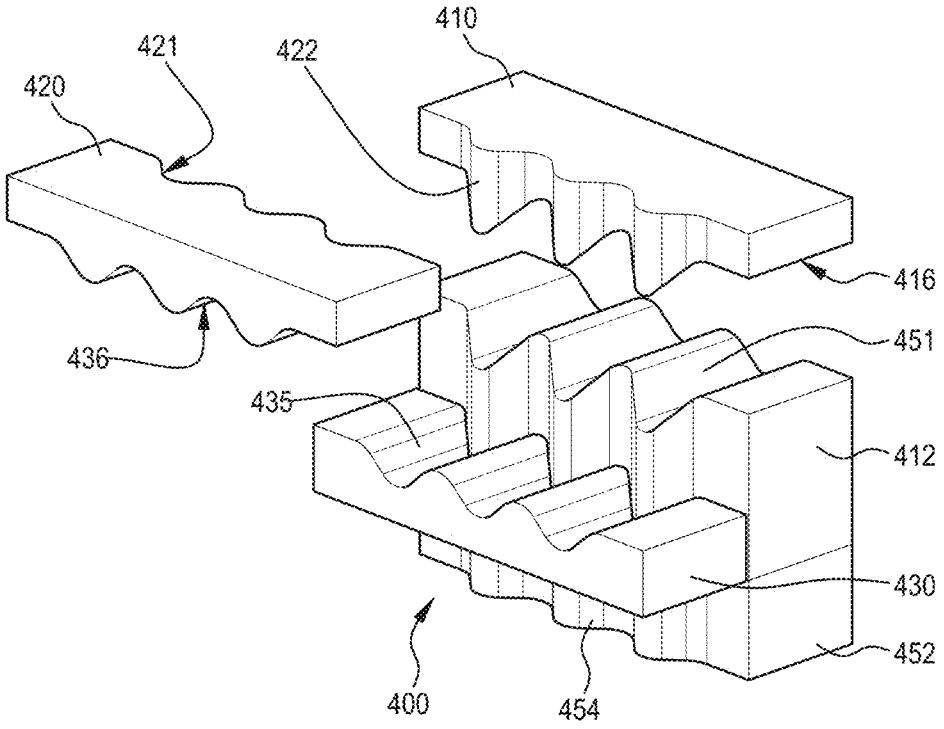
FIG. 5 provides a further process schematics for forming a contoured metal sheet corner element using the tooling arrangement illustrated in FIG. 3.
Figure 5B:
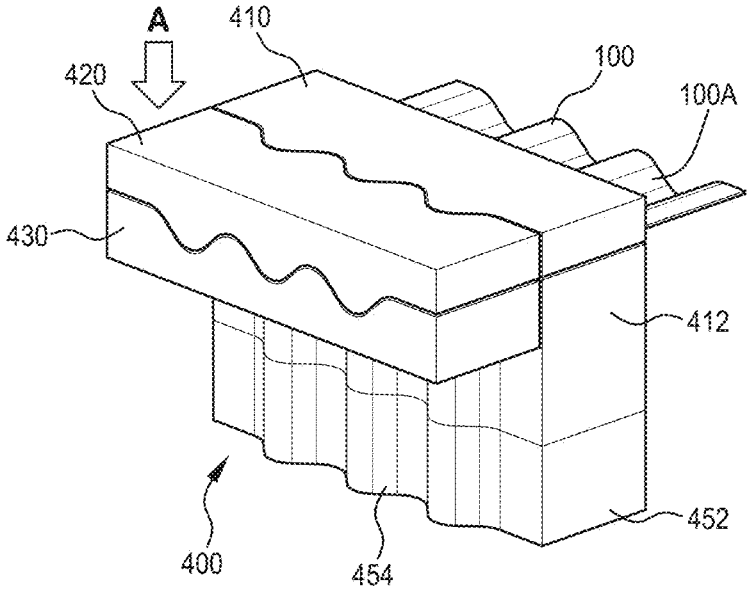
Figure 5C:
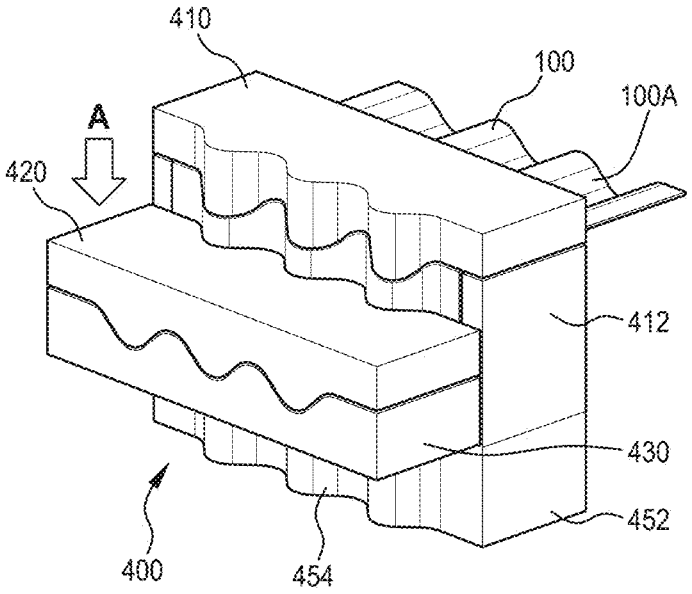
Figure 5D:
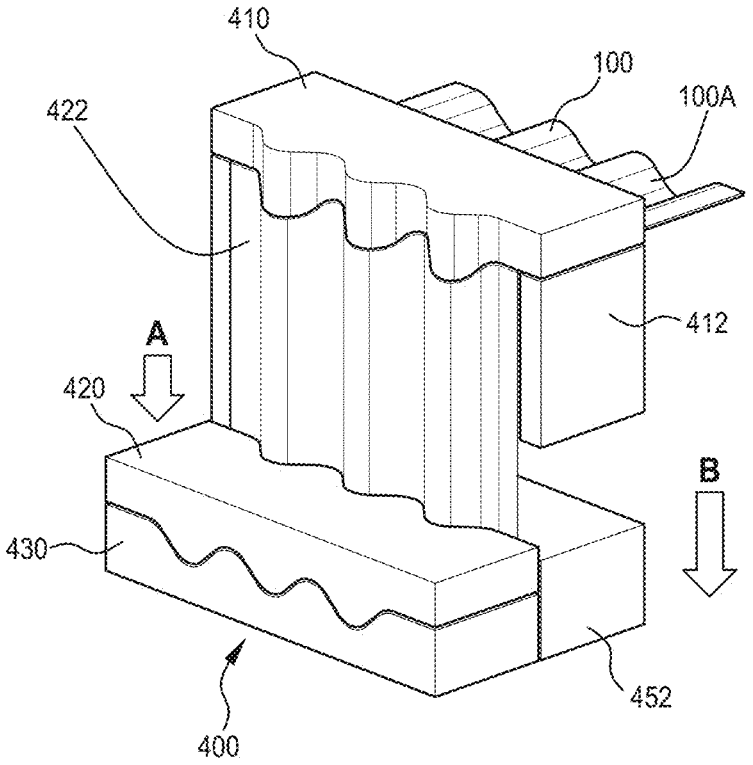

As shown in FIGS. 4 and 5, in use, the illustrated tooling arrangement 400 can be used to bend a contoured metal sheet 100 over two bending edges 442 and 444 to form a contoured metal sheet element 300 such as is illustrated in FIG. 2. The method of using that tooling arrangement 400 is as follows:

1) A contoured metal sheet 100 is provided having a longitudinal axis L extending along the length of the sheet 100 and a contoured profile, in this case having a repeating cross-sectional shape (though in other embodiments, that profile may be irregular or non-uniform) that extends perpendicular to the longitudinal axis of the metal sheet 100.
2) As shown in FIGS. 4A and 5B, a first sheet section 105 of the contoured metal sheet 100 is clamped between the engagement surface 416 of the upper engagement die 410 and the securing surface 415 of lower securing die 412, positioning the fold line F1 where the bend in the sheet 100 is desired with the first bending edge 444. Additional length of the metal sheet 100A extends out from between the securing section 405.
3) A second sheet section 106 of the contoured metal sheet 100 that extends from the first sheet section 105 from fold line F1 is located between the pressing surface 436 of the forming die 420 and seating surface 435 of seating die 430. The remaining length of metal sheet 100B extends out from the forming section 407. It should be appreciated that for the sake of clarity, this additional length of metal sheet 100B has not been shown in FIG. 5 (again, metal sheet section 100B is shown in FIG. 4).
4) The forming die 420 and seating die 430 are moved relative to the backing surface 422 in the direction of Arrow A (FIGS. 4(B) and 5(B)). The first sheet section 105 is clamped in position, and thus remains stationary in position between the engagement surface 416 and the securing surface 415. As described above, the pressing surface 436 and seating surface 435 are spaced apart to allow the contour metal sheet 100 to slide between the surfaces when the forming die 420 is moved. Movement of forming die 420 in direction A bends the second sheet section 106 about a bend radius R1 to position the second sheet section 106 at a 90 degree angle relative to the first sheet section 105 over and around the first bending edge 444 about the fold line F1. The backing surface 422 cooperates with the forming surface 421 to engage the second sheet section 106 therebetween during movement of the forming die 420 and seating die 430 in direction A.
5) Movement of the second sheet section 106 of the contoured metal sheet 100 from between the pressing surface 436 and seating surface 435, over second bending edge 442 and onto the forming surface 421 about bend radius R2 progressively transforms the contoured profile of the second sheet section 106 into a new contoured profile. The new contoured profile of the second sheet section 106 comprises a symmetrical mirror of the contoured profile of the first sheet section 105 about the fold line F1. Essentially, peaks originally in the contoured profile of the second sheet section 106 become troughs in the new contoured profile and the troughs originally in the contoured profile of the second sheet section 106 become peaks in the new contoured profile (see for example the comparison of profiles between the solid lined sheet and dashed line sheet shown in FIG. 1(C)) as the metal sheet 100 is bent over the fold line F2/bend radius R2.
6) The following die 452 and second backing surface 454 of the following section 450 is initially positioned adjacent to and aligned with the backing surface, with the following die being positioned adjacent with and aligned with the securing die 412 (FIGS. 4B and 5B and 5C). Once the forming die 420 and seating die 430 moves to a position where they are no longer overlapping and the backing surface 422 becomes remote from the forming surface 421 (FIGS. 4C and 5D), the second backing surface 454 of the following section 450 is utilised to cooperate with the forming surface 422 to engage and compress the second sheet section 106 at a point adjacent to the second bending edge 442. In the illustrated embodiments, it is moved in the direction of arrow B to maintain its position opposite the second bending edge 444. The second backing surface 454 cooperates with the forming surface 454 to engage and compress the second sheet section 106 at a point adjacent to the second bending edge 444. The contoured metal sheet 100 is continually feed between the pressing surface 436 and seating surface 435 over second bending edge 442 and onto the forming surface 421 about bend radius R2 to transform the entire profile of the second sheet section 106 to the symmetrical inverse (out of phase reflection) of the original profile contoured profile.

The above process and tooling allows the bend to be positioned at any desired point along the length of the contoured metal sheet 100 and for the contours to run continuously on both sheet sections of the bent sheet 100 and merge about the fold line F1 making a neat join at the intersection of two sheet sections 105 and 106. The position or length of the bend is not limited by the size of the tooling, in particular the size of the tool face used to transform the entire profile of the second sheet section 106 to the symmetrical inverse (out of phase reflection) of the original profile contoured profile. The present invention enables relatively small tools and tool faces to be used, with the position of the bend on a length of a contoured metal sheet to limited only by relative travel distance allowed in the apparatus between the forming section 407 (and forming die 420) and the securing section 405 and related travel by the following section 450 (and comprising following die 452).

It should be appreciated that movement of the forming die can be actuated by any number of processes including electric, hydraulic of other suitable drives, piston arms or the like.

It should be appreciated that whilst the forming section 407 is described as being moved relative to the securing section 405 in the above described process, preferably with the securing section 405 being held stationary, in other embodiments the securing section 405 could be moved in the opposite direction to arrow A relative to the forming section in order to produce the same results. In these embodiments, the forming section 407 could be held stationary and the securing section 405 moved. In yet other embodiments, both the securing section 405 and the forming section 407 are moved apart relative to one other. In all embodiments, the following section 450 is positioned take the place of the backing surface 422 and cooperate with the forming surface 421 to engage and compress the sheet section at a point adjacent to the second bending edge 442.

It should also be appreciated that the folding plane or plane of symmetry across the fold line between the securing surface 415 and forming surface 421 (and the resulting first sheet section 106 and second sheet section 106) which runs through the fold line F1) is the half-angle between those surfaces 415, 421. This creates a symmetrical mirror image of the contoured profile of the metal sheet 100 across the fold line F. The plane geometry as defined by the folding plane assists in ensuring that during the bending process no part of the metal sheet is subject to tensile or compressive force, only pure bending.

The process and tool arrangement 400 described and illustrated above could be used as a stand-alone process for forming contoured metal sheet elements or as a further forming process step on a sheet rolling line, such as a corrugated sheet rolling line or process.

The resulting bent contoured metal sheet element can be cut, chopped parted or otherwise separated into separate parts at any desired location to provide a desired configured contoured metal sheet element.

It should be appreciated that movement of the forming die can be actuated by any number of processes including electric, hydraulic of other suitable drives, piston arms or the like.

Those skilled in the art will appreciate that the invention described herein is susceptible to variations and modifications other than those specifically described. It is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

The invention claimed is:

1. A method of bending a contoured metal sheet, the contoured metal sheet having a longitudinal axis extending along the length of the contoured metal sheet, the contoured metal sheet having a contoured profile that extends perpendicular to the longitudinal axis of the contoured metal sheet, the method comprising:

(A) securing a first sheet section of the contoured metal sheet in a securing section between a securing surface of a securing member and an engagement surface of an engagement member, the securing section also including a backing surface positioned at a selected angle relative to the securing surface about a first bending edge formed therebetween;

(B) positioning at least part of a second sheet section of the contoured metal sheet in a forming section between a forming member having a pressing surface and a forming surface, and a seating member having a seating surface, the seating member configured to cooperate with the forming member to engage the second sheet section between the pressing surface and the seating surface, and also allow the second section of contoured metal sheet to slide therebetween;

(C) moving the forming section and the securing section relative to one another to:

bend the first sheet section the selected angle relative to the second sheet section over the first bending edge; and feed the second sheet section from between the pressing surface and the seating surface, over a second bending edge, to between the forming surface and the backing surface, the forming surface being orientated the selected angle to the pressing surface about the second bending edge formed therebetween, the forming surface being shaped with a contour comprising a substantially symmetrical mirror profile to the contoured profile of the contoured metal sheet; and the backing surface having a complementary and cooperating profiled surface to the forming surface which is configured to cooperate with the forming surface to engage the second sheet section therebetween, thereby transforming the contoured profile of the second sheet section into a symmetrical mirror of that contoured profile; and (D) positioning a following section substantially adjacent to the second bending edge, the following section being configured to cooperate with the forming surface to engage and compress a portion of the second sheet section of the contoured metal sheet therebetween when the relative movement between the securing section and the forming section moves the backing surface to a position remote from the forming surface of the forming member.

2. The method according to claim 1, wherein the backing surface becomes remote from the forming surface at a position where the backing surface and the forming surface are unable to cooperate to engage and compress the second sheet section therebetween.

3. The method according to claim 1, wherein the following section includes a second backing surface having a complementary and cooperating profiled surface to the forming member, and the second backing surface of the following section is initially positioned adjacent to and aligned with the backing surface.

4. The method according to claim 3, wherein the second bending edge has a second bend radius and the second backing surface overlaps the second bend radius by at least the size of the bend radius.

5. The method according to claim 1, wherein the following section is initially positioned adjacent with and aligned with the securing member.

6. The method according to claim 1, wherein the first sheet section of the contoured metal sheet is clamped between the securing surface of the securing member and the engagement surface of the engagement member.

7. The method according to claim 1, wherein the backing surface forms part of the securing member.

8. The method according to claim 1, wherein the relative movement between the securing section and the forming section comprises at least one of:

the securing section being held stationary, and the forming section being moved away from the securing section; or the forming section being held stationary, and the securing section being moved away from the forming section.

9. The method according to claim 1, wherein the relative movement between the securing section and forming section includes the forming surface and backing surface sliding apart relative to one another, and optionally also positions the second sheet section at the selected angle relative to a third sheet section now engaged between the pressing surface and seating surface.

10. The method according to claim 1, wherein the forming surface and backing surface are spaced apart, in use, so that the second sheet section can be engaged and deformed therebetween, and allow relative lateral sliding movement, between at least the forming surface and the second sheet section.

11. The method according to claim 1, wherein the second bending edge has a bend radius of less than 5 mm and wherein the selected angle between the pressing surface and forming surface is between at least one of: 5 and 175°, 10 and 150°, or 60 and 120°.

12. A bending arrangement for bending a contoured metal sheet, the contoured metal sheet having a longitudinal axis extending along the length of the contoured metal sheet, the contoured metal having a contoured profile that extends perpendicular to the longitudinal axis of the contoured metal sheet, the bending arrangement comprising:

(A) a securing section including a securing member having a securing surface and an engagement member having an engagement surface which is configured to cooperate with the securing surface to engage and secure a first sheet section of the contoured metal sheet therebetween, the securing section also including a backing surface positioned at a selected angle to the securing surface about a first bending edge formed therebetween;

(B) a forming section including:

a forming member having a pressing surface and a forming surface, the forming surface being orientated at a selected angle to the pressing surface about a second bending edge formed therebetween, the forming surface being shaped with a contour comprising a substantially symmetrical mirror profile to the contoured profile of the contoured metal sheet, the backing surface having a complementary and cooperating profiled surface to the forming surface of the forming member, the forming surface being configured to cooperate with the backing surface to engage and compress a sheet section of the contoured metal sheet therebetween; and a seating member including a seating surface, the seating member configured to cooperate with the forming member to engage at least a portion of a second sheet section of the metal sheet between the pressing surface and the seating surface, and also allow the second sheet section of contoured metal sheet to slide therebetween, (C) a following section configured to be positioned adjacent to the second bending edge to cooperate with the forming surface, the following section also being configured to engage and compress a sheet section of the contoured metal sheet therebetween when the backing surface of the securing member becomes remote from the forming surface, wherein the forming section and securing section are configured to move relative to one another to feed the second sheet section from between the pressing surface and seating surface over the second bending edge and between the forming surface and backing surface and thereby:

position the first sheet section at the selected angle relative to the second sheet section of the contoured metal sheet; and transform the contoured profile of the second sheet section into a new contoured profile comprising a symmetrical mirror of that contoured profile.

13. The bending arrangement according to claim 12, wherein the backing surface becomes remote from the forming surface at a position where the backing surface and the forming surface are unable to cooperate to engage and compress the second sheet section therebetween.

14. The bending arrangement according to claim 12, wherein the following section includes a second backing surface having a complementary and cooperating profiled surface to the forming member.

15. The bending arrangement according to claim 12, wherein second bending edge has a second bend radius and the second backing surface overlaps the second bend radius by at least the size of the bend radius.

16. The bending arrangement according to claim 12, wherein the forming surface and the backing surface are configured to slide apart relative to one another.

17. The bending arrangement according to claim 12, wherein the backing surface comprises part of the securing member.

18. The bending arrangement according to claim 12, wherein the securing member and the engagement member are configured to clamp the first sheet section of the contoured metal sheet between the securing surface and the engagement surface thereof.

19. The bending arrangement according to claim 12, wherein the forming surface and backing surface are spaced apart, in use, so that the second sheet section can be engaged and deformed therebetween, and allow relative lateral sliding movement, between at least the forming surface and the second sheet section.

20. The bending arrangement according to claim 12, wherein the second bending edge forms a second bend radius R1 about which the contoured metal sheet is bent and R1 comprises a bend radius of less than 5 mm, and wherein the selected angle between the pressing surface and forming surface is between at least one of: 5 and 175°, 10 and 150°, or 60 and 120°.

* * * * *